US005459899A

United States Patent [19]

Bauer

[11] Patent Number: 5,459,899

[45] Date of Patent: Oct. 24, 1995

[54] INTERSTITIAL FLOSSING TOOTHBRUSH

[76] Inventor: Jerome Bauer, 2 Bay Club Dr., Spt. 16T, Bayside, N.Y. 11360

[21] Appl. No.: 350,722

[22] Filed: Dec. 7, 1994

Related U.S. Application Data

[63] Continuation of Ser. No. 66,484, May 24, 1993, abandoned.

[51] Int. Cl.[6] ..... A46B 9/04

[52] U.S. Cl. ..... 15/167.1; 15/110; 15/188; 15/DIG. 5; 601/141

[58] Field of Search ..... 15/110, 167.1, 15/188, DIG. 5, 167.2; 433/216; 601/139, 141

[56] References Cited

U.S. PATENT DOCUMENTS

| | | | |
|---|---|---|---|
| 1,059,426 | 4/1913 | Barnes | 15/167.1 |
| 1,482,027 | 1/1924 | Ochse | 15/167.1 |
| 1,657,450 | 1/1928 | Barnes | 15/167.1 |
| 1,833,555 | 11/1931 | Bell et al. | 601/141 |
| 1,910,414 | 5/1933 | Varga | 15/188 |
| 1,943,225 | 1/1934 | McIntyre | 15/167.1 |
| 2,040,245 | 5/1936 | Crawford | 15/167.1 |
| 2,206,726 | 7/1940 | Lasater | 15/188 |
| 2,209,173 | 7/1940 | Russell | 15/167.1 |
| 2,279,355 | 4/1942 | Wilensky | 15/188 |
| 2,622,259 | 12/1952 | Chauvin | 15/167.1 |
| 2,797,424 | 7/1957 | Olson | 15/167.1 |
| 2,807,820 | 10/1957 | Dinhofer | 15/110 |
| 2,978,724 | 4/1961 | Gracian | 15/167.1 |
| 3,007,441 | 11/1961 | Eyer | 15/167.1 |
| 3,230,562 | 1/1966 | Birch | 601/141 |
| 3,359,588 | 12/1967 | Kobler | 15/188 |
| 3,553,759 | 1/1971 | Kramer et al. | 15/188 |
| 4,268,933 | 5/1981 | Papas | 15/110 |
| 4,356,585 | 11/1982 | Protell et al. | 15/167.1 |
| 4,519,111 | 5/1985 | Cavazza | 15/DIG. 5 |
| 4,672,706 | 6/1987 | Hill | 15/167.1 |
| 5,040,260 | 8/1991 | Michaels | 15/188 |
| 5,201,092 | 4/1993 | Colson | 15/DIG. 5 |

FOREIGN PATENT DOCUMENTS

| | | | |
|---|---|---|---|
| 2587183 | 3/1987 | France | 15/DIG. 5 |
| 3528596 | 2/1987 | Germany | 15/167.1 |
| 91-19437 | 12/1991 | WIPO | 15/167.1 |

*Primary Examiner*—Mark Spisich
*Attorney, Agent, or Firm*—Bauer & Schaffer

[57] ABSTRACT

A toothbrush for brushing tooth surfaces and for flossing and picking foreign matter from spaces and interstices on and between and around teeth and gums.

4 Claims, 2 Drawing Sheets

Fig. 1
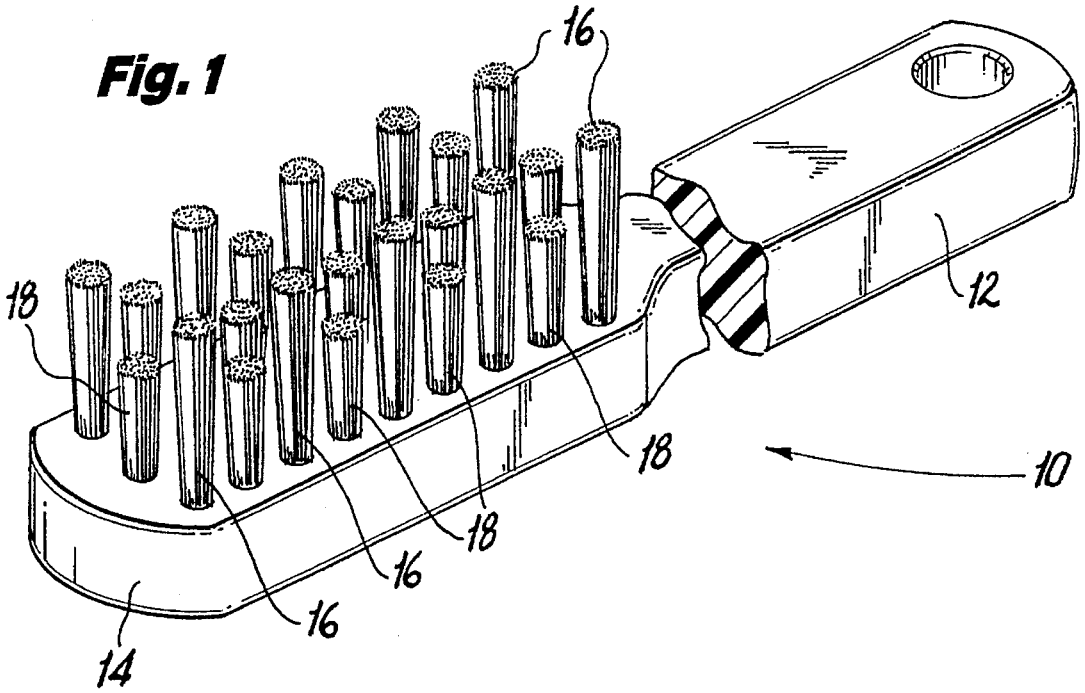
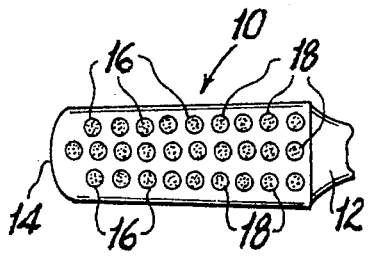
Fig. 1A
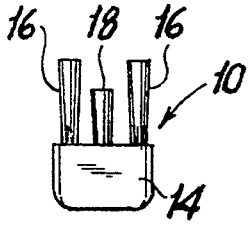
Fig. 1B
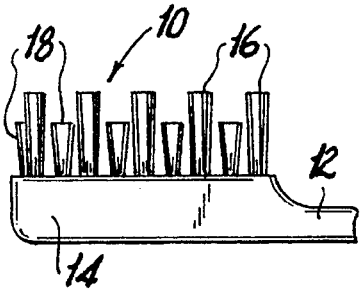
Fig. 1C
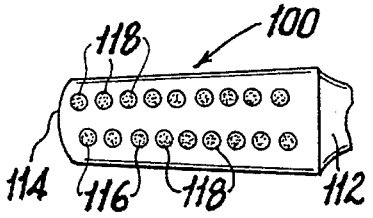
Fig. 2A
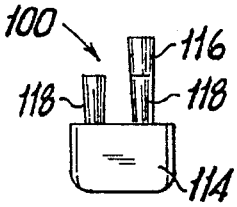
Fig. 2B
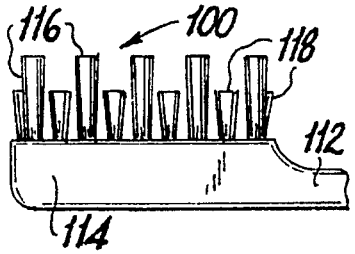
Fig. 2C
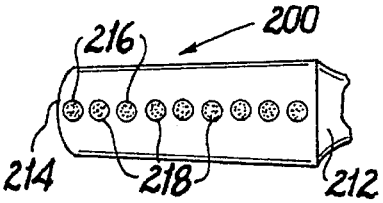
Fig. 3A
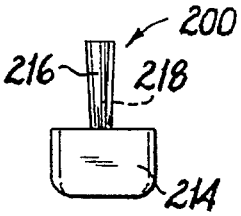
Fig. 3B
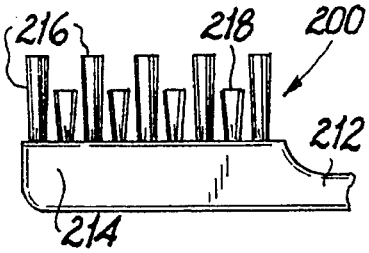
Fig. 3C

INTERSTITIAL FLOSSING TOOTHBRUSH

This is a continuation of Ser. No. 08/066,484, filed May 24, 1993, now abandoned.

BACKGROUND OF THE INVENTION

The present invention relates to toothbrushes but more particularly it combines the functions of a toothbrush with that of dental floss and toothpicks. The present toothbrush not only cleans the surfaces of the teeth but it also enters into the areas and spaces between and about the teeth that were previously accessible only to toothpicks and dental floss so as to clean the teeth and gums thereat. This is accomplished in the present invention while also permitting the performance of the usual tooth brushing functions.

DESCRIPTION OF THE PRIOR ART

Latest U.S. Pat. No. 4,356,585 is typical of the prior art that refers to a toothbrush having rows of tooth-cleaning bristles of different length and shape, but which fails to suggest or hint at their use for the specific combined functions of the present invention. Rather it is directed more particularly to its tooth-groomer purposes.

SUMMARY OF THE INVENTION

The present invention teaches a toothbrush that is provided with a specific arrangement of tooth cleaning means that includes both surface brushing means and flossing means that enter and penetrate into spaces and interstices in and between teeth and gums to clean the same and to eject foreign matter from between the teeth and gums in the manner of dental floss and toothpicks. Such "brushing" and "flossing" cleaning means are working parts of the same toothpick to provide a combined toothbrush specifically intended to simultaneously brush the tooth surfaces and to pick into spaces and interstices in and between the adjacent teeth and gums to eject foreign matter therefrom and to pick and floss them clean during selective movements of the toothbrush handle.

For convenience of understanding the new and novel aspects of the present invention and without limiting the scope or breath of the same, the reference to "flossing position(s)" is intended to include the positions and attitudes the flossing means assume as they move interstitially between teeth and gums during the performance of their picking and flossing cleaning functions. "Flossing" as broadly referred to hereinafter are those functions performed by dental floss, toothpicks and other devices used to dislodge foreign matter from between teeth and gums to clean and stimulate the same.

DESCRIPTION OF THE DRAWINGS

FIG. 1 is a perspective view of the combined toothbrush of the preferred embodiment of the present invention with a portion of the handle deleted for convenience of illustration;

FIG. 1A is a top view of FIG. 1;

FIG. 1B is an end view of FIG. 1;

FIG. 1C is a side view of FIG. 1;

FIGS. 2A, 2B and 2C are top, end and side views respectively of a modification of the invention;

FIGS. 3A, 3B and 3C are top, end and side views respectively of another modification of the invention;

Figure 4A:
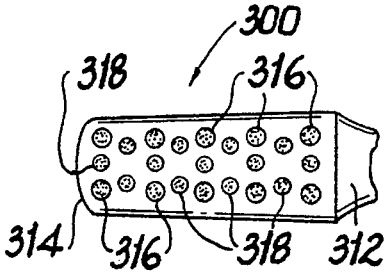
FIGS. 4A, 4B and 4C are top, end and side views of still another embodiment of the invention.

Referring now to the preferred best mode of the invention illustrated generally in FIG. 1, the toothbrush that is shown is generally identified by the numeral 10. It comprises an essentially standard handle 12 and a working head end 14 of any desired width and length. As the description proceeds it will become clear that the toothbrush 10 may be made in different sizes such that the length and width of the ends 12 and 14 may be longer and/or wider to suit and fit the needs of children, young persons and older adults.

Supportingly mounted on the head 14 are a plurality of specifically different cleaning means which include relatively spaced longer flossing means 16 and relatively spaced shorter tooth surface brushing means 18. In the drawings it will be seen that the cleaning means 16 and 18 are shown in the form of bundles of individual conventional tooth cleaning bristles that may be made of natural or synthetic fibers. The plurality of bundles of flossing cleaning means 16 may be conveniently arranged in one or more of a plurality of rows extending along and for at least a portion of the length of the handle head 14. Although the rows are shown to be relatively straight, as the description proceeds it will be clear that they may not necessarily be so arranged.

For example, in FIGS. 1, 1A, 1B, 1C, 7 and 8 there are at least two rows of flossing means 16 that are relatively spaced from each other in the direction of the width of the head 14. Only two rows are shown for ease of understanding and illustration. If desired, more or less than a plurality of two such rows may be provided relatively spaced along the width of the head 14 in accordance with the teaching of the invention. It will be noted that the plurality of bundles of flossing means are also relatively spaced extending lengthwise along the head 14.

The relative spacing of the flossing means 16 is approximately that of the average width of the teeth with which the toothbrush is to be used for cleaning purposes. It has been found that the relative spacing of the flossing means 16 is not critical because of the flexibility and bendability of the bristles. Such bristle flexibility and bendability is sufficient to make up for the variations in tooth widths as will become clear. For convenience the relative spacing of the flossing means 16 in both the lengthwise and widthwise directions of the head 14 will vary depending upon the use to which the toothbrush is put.

For example, when the toothbrush is to be used for young children whose teeth are relatively narrow in width, the relative lengthwise and widthwise spacing of the flossing bundles 16 will be smaller than it would be for toothbrushes used for young adults or for adults whose teeth width is greater than that of children. Hence, the relative spacing between the flossing means will be approximately that of the average width of the tooth with which the present toothbrush is intended to be used. Therefore the relative space between the flossing means 16 will be larger for adults than it will be for children. Similarly, the longer length of the flossing means 16 will be selectively sized to extend and project into the interstitial spaces between and around the teeth and gums to an extent of between at least 10% to more than 50% of the thickest teeth. This assures that the picking and flossing movements of the flossing means 16, when pressed into flossing positions against the fronts and/or the backs of the teeth, will extend for at least the depth of 10% to more than 50% of the thickness of the teeth with which they come into contact.

This means that the flossing means 16 are longer than the brushing means 18 by at least ten percent to more than fifty percent of the thickest teeth to be cleaned by them. This will thereby assure that the picking and flossing movements of the flossing bristles 16 will be able to be completely performed when they are in their flossing positions. When the toothbrush handle 12 is manipulated, the individual bristles of the flossing means each will function as many different strings of floss and toothpicks each moving in different picking and flossing cleaning directions in response to the movements of the toothbrush handle. The flossing means 16 function as a plurality of individually moving toothpicks and floss as they are moved into and along their flossing positions in response to and in accordance with the brushing manipulations of the toothbrush handle. This results in picking, flossing and cleaning the spaces between and around the teeth and gums with which they come into contact.

Figure 8:
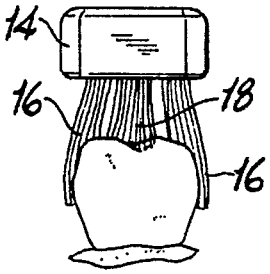
FIG. 8 is an end view of a tooth and related gums illustrating another use of the inventive embodiment of FIG. 1.
Figure 7:
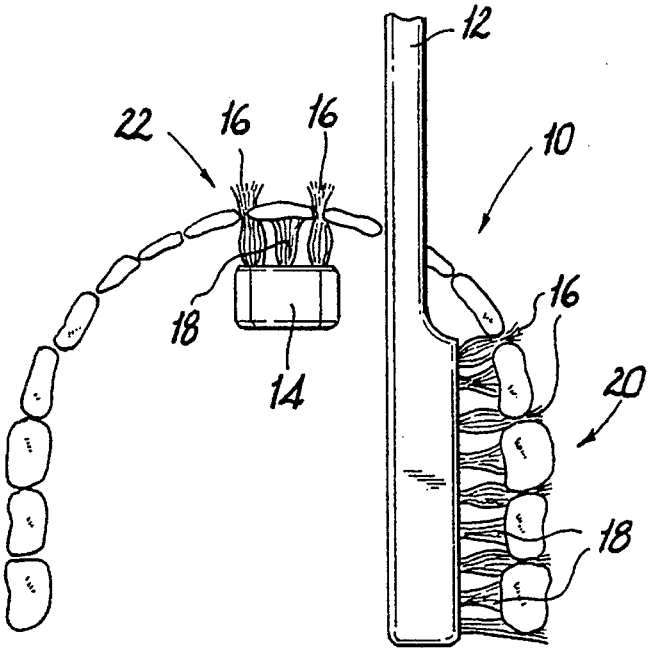
FIG. 7 is a plan view of a set of teeth illustrating various ways of using the best mode of the invention of FIGS. 1, 1A, 1B and 1C.

Mounted on the toothbrush head in the spaces between the flossing means 16 are a plurality of tooth surface brushing means 18. The brushing means 18 may be of the same material as that of the flossing means 16. They are also flexible and bendable so that when their individual exposed ends are pressed into surface contact with the teeth, the bristles deform to cause them to bend from their original pointed straight narrow shapes into flattened enlarged area surface contact with the engaged tooth surfaces in accordance with the amount of selective pressure applied to them by the handle 12. This bending and more complete surface area contact with the teeth is illustrated more fully in FIGS. 7 and 8. In FIGS. 7 and 8 the bent brushing bristles 18 spread apart and bend outward in different directions to occupy substantially part or all of the spaces between the relatively spaced flossing means 16. This enables the brushing means 18 to more completely clean the tooth surfaces between the spaced flossing means during the brushing movement of the handle 12.

The toothbrush 10 is used by grasping it by the handle 12 to enable it to be selectively applied to teeth and surfaces thereof and to be manipulated and to apply the desired pressure of the cleaning means to the selected teeth. Any desired form of movement may be imparted to the cleaning means 16 and 18 as, for example, up and down, sidewise, rotary movement or any combination thereof. As illustrated at the arrow 20 in FIG. 7, the cleaning means can be applied to the interior surfaces of the teeth as well as to the exterior surfaces in the manner as is shown at 20. In accordance with the illustration shown at arrow 22 in FIG. 7, the cleaning means may be applied to the front teeth in a vertical position and concentrated on any one or more teeth including at the central portion of the mouth. The cleaning there shown means are pressed vertically against the back of a selected tooth or teeth or, if desired, against the front of the teeth forcing the flossing means 16 into their flossing position.

FIG. 8 shows the cleaning means applied to the bite surfaces or tops of the teeth. When applied to the teeth as is illustrated in FIGS. 7 and 8, the longer flossing means 16 initially come into contact with the teeth before the relatively shorter brushing means 18. In response to pressure applied to the handle 12 the ends of the flossing means engage the tooth surfaces. At that time some of their bristles may become immediately aligned with the interstices and/or spaces between the teeth and the gums to readily enter into their flossing positions therebetween, and to be manipulated partially into and out of their flossing positions with some of the flossing bristles moving out of their flossing positions while others replace them during the brushing movements of the handle.

Even though some flossing bristles may first come into contact with the tooth surfaces in response to pressure applied to them, and further in response to the brushing movements, the flossing bristles are forced to deflect and ride along the sides of the teeth and to then slide outwardly along the engaged teeth surfaces to enter into the spaces and interstices between the teeth and gums to penetrate to their flossing positions therebetween as is shown at 20 and 22 in FIG. 7. In those instances where there are no adjacent interspacial teeth for the flossing means to penetrate between, the same may ride along the sides of the teeth to encompass the side walls of the teeth much as is exemplified in FIG. 8. In such cases the side walls of the teeth are flossed and cleaned by the longer flossing means.

The relative lengthwise and widthwise spacing of the flossing means 16 is unique in that it enables their use in any angular flossing position about the gums and teeth as is illustrated at 20 and 22 in FIG. 7. Each of the individual bristles of the combined bundle of bristles of each flossing means functions much like that of a plurality of yieldable, bendable toothpicks that respond to the handle pressure to seek out spaces in teeth and the interstices and crevices between the teeth and the gums to enter and penetrate therebetween. This enables each bristle of each bundle of flossing means to pick and eject foreign matter from the penetrated spaces and to clean the engaged surfaces and floss the teeth and gums in response to movements of the handle. The brushing movements cause the flossing means to rub and ride along the surfaces of the teeth and thereby clean the same as well as the gums against which they come into contact.

As the handle 12 is manipulated, selected ones of the flossing means can be directed to penetrate into desired spaces and crevices in and about tooth surfaces. During movements of the handle the flossing means clean and massage the teeth and the gums in the flossing positions. The flossing position 22 of FIG. 7 is achieved by reason of the widthwise spacing of the flossing means and illustrates how well the toothbrush is used to clean and floss the teeth and the gums when the toothbrush is in its vertical or near vertical flossing position relative to the teeth.

The bundles of brushing means 18 are similarly located by appropriate selective manipulation of the handle to brush the surfaces of the teeth between the relatively spaced flossing means 16. The brushing means 18 are relatively spaced in and/or between the flossing means and they provide for more efficient cleaning of the tooth surfaces by being arranged relatively spaced in rows widthwise between the flossing means 16 as is seen more clearly in FIGS. 1, 1A, 1B, 7 and 8.

The embodiment of FIGS. 2A, 2B, and 2C differs from that of FIG. 1 in that one of the lengthwise rows of flossing means and brushing means is omitted. Like structures of FIGS. 2 to the of FIG. 1 are numbered in the 100 series with the tens digits thereof corresponding to the same tens digits in the description of FIG. 1 The toothbrush generally identified by the numeral 100 includes a handle 112 and a row of a plurality of flossing means 116 relatively spaced along the head 114. Also relatively spaced along the length of the head are a plurality of brushing means 118 arranged in the spaces between the flossing 116 means while an additional row of a plurality of brushing means 118 is also provided to aid in cleaning tooth surfaces.

The use and operation of the embodiment 100 is essentially like that of 10 except for the omission of a row of brushing means. The toothbrush 10 is used to concentrate the flossing and tooth picking functions on one side of a tooth rather than on opposite sides as is enabled in FIG. 1. The result is effectively the same with both toothbrushes, but the present toothbrush 100 can be used with infants and young children to introduce them to the interstitial flossing and picking and brushing functions performed by a single toothbrush.

The structure of the embodiment of FIGS. 3A, 3B and 3C are identified in the 200 series with the tens digits thereof corresponding to that of FIG. 1. Here again, it will be noted that the tooth cleaning means 216 and 218 are arranged in a single row with the brushing means 218 located in the spaces between the flossing means 216. Although the single row is shown to be in a straight line, this should not constitute a limitation upon the scope of the invention because they can be staggered with one or more of the brushing means 218 and/or flossing means 216 being wider than the other and variably misaligned with each other. It should be clear that this is the same and applies equally to each of the embodiments described in this invention.

Embodiment 200 is well suited for use by young children and adults whose teeth and gums are sensitive to tooth brushing. The manner of use of the present embodiment is like that of embodiment 100 because it is not able to floss on more than one side of a tooth at a given time when the handle is in a vertical position. However, like that of the embodiment 10, this toothbrush 200 and the toothbrush 100 will move into the flossing positions 20 when in the horizontal position to clean a select plurality of teeth at a time. The narrower arrangement of the cleaning means 116 and 118 of the toothbrush 100 and also 216 and 218 of toothbrush 200 enables the use of a narrower head 114 and 214 respectively that is more comfortable for the intended users.

Figure 4B:
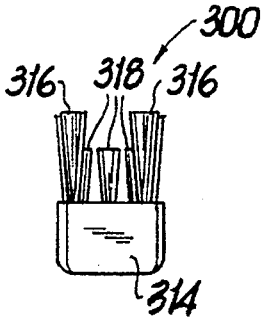
Figure 4C:
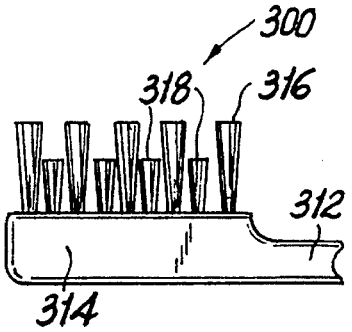

The structure of the embodiment shown in FIGS. 4A, 4B, and 4C, like those previously described, is identified by numbers in the 300 series with their tens digits corresponding to those of FIG. 1. Toothbrush 300 is similar to the structure 100, except for the intermediate single row of brushing means 16. In its stead toothbrush 300 illustrates the ability to use a plurality of bundles of cleaning means 318 interspaced between the flossing means 316 that are more numerous and provide greater area tooth surface brushing engagement than that of the cleaning means 16 of the structure 10. Once again, because of the compressed arrangement of cleaning means 316 and 318, the toothbrush head 314 may be narrower than that of the head 14.

Figure 5A:
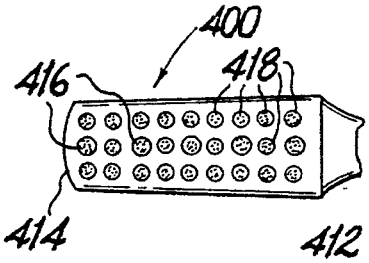
FIGS. 5A, 5B and 5C are top, end and side views respectively of a further embodiment of the invention.
Figure 5B:
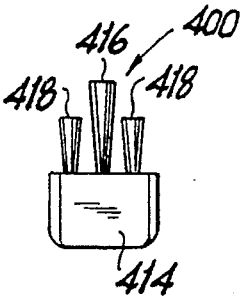
Figure 5C:
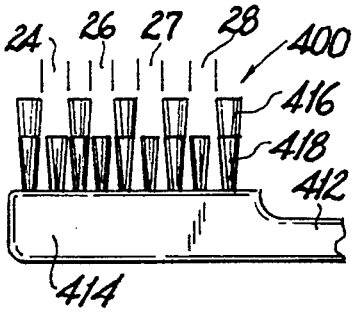

In the embodiment identified by the numeral 400 of FIGS. 5A, 5B and 5C the tens digits thereof correspond to like structural details of the embodiment of FIG. 1. There is a single row of flossing means 416 in the present embodiment that extends lengthwise along the head 414. As in prior described embodiments, the flossing means 416 are relatively spaced in the manner as described with respect to the embodiment 10, while the remaining shorter cleaning means 418 are interspaced therebetween. In the present embodiment 400 two additional rows of brushing means 418 border the opposite sides of the flossing means 416 opposite to that of the embodiment 10 of FIG. 1.

Figure 6:
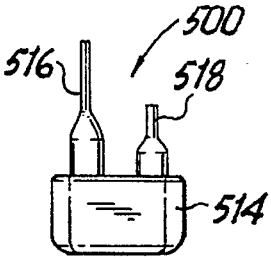
FIG. 6 is an end view of another embodiment of the cleaning means.

The functions of each of the described embodiments are essentially the same as those previously described with respect to the embodiment of FIG. 1. Each of the embodiments described previously teach the cleaning means to be comprised of bundles of toothbrush bristles of the type commonly in use in toothbrushes. However, FIG. 6 depicts the use of non-bristle type cleaning means 516 and 518 that are made of natural rubber or synthetic materials, as plastic, that are bendable and flexible, the base of which is enlarged for easy mounting in the toothbrush head 514. The cleaning means 516 and 518 narrow at their cleaning ends to enable them to function in the manner of the described bristle type cleaning means, that is to say, when their narrow ends are selectively located and in contact with a tooth in the area of a space or crevice between teeth and gums, they will squeeze and bend and follow the contour about the curvature of the contacted teeth to enable them to be forcibly moved into and removed from their flossing positions.

The flossing means function as toothpicks to remove foreign matter from between the teeth and the gums at their interstitial spaces and crevices. As the handle is moved the flossing means move correspondingly to ride along the surfaces of the engaged teeth and gums to actually floss and to enter and pick between them to clean the same in the manner as does dental floss. The shorter brushing means bend upon contact with the tooth surfaces and move into flattened surface area rubbing cleaning engagement with the tooth surfaces to clean them.

The flossing means of each of the embodiments of the invention have been described as being relatively spaced both lengthwise and widthwise to assure their movements into interspacial flossing positions between the teeth to perform their flossing and picking functions. To further enhance their movements into their flossing positions it will be noted that the toothbrush heads may be tapered from their narrower distal ends to their wider remote ends at which their handles begin.

This gradual widening of the heads enables the flossing means of the embodiments 10 and 300 of FIGS. 1, 1A, 1B and 1C and 4A, 4B and 4C respectively to have varying widthwide relative spacing from the narrower ends of their heads to the wider ends of their heads. As a result, at least one set of relatively widthwise spaced flossing means will always most nearly correspond and coincide with the width of the teeth to which they are selectively applied to assure they will move readily and easily into flossing positions with respect thereto.

Similarly, the relative lengthwise spacing of the flossing means of each of the described embodiments may be varied to assure that at least one adjacent lengthwise set thereof most nearly matches the width of teeth to which the same is applied for flossing and picking. An exemplarily illustration of this appears in FIG. 5C. It is clear from this illustration that the relative lengthwise spacing of the flossing means changes and increases from the distal end of the head 414 in the direction of the bundle 412. From the illustration it is seen that the space 24 is smaller than space 28 and that the intermediate spaces 26 and 27 gradually increase one more than the other. This increasing or decreasing spaced relationship of the flossing means both widthwise and lengthwise is applicable for use in the spaced arrangements of the cleaning means of each of the disclosed embodiments.

While many modifications and changes have been described herein, others will become apparent to those who are skilled in this art. Accordingly, the present disclosure is intended to be illustrative only and not limiting of the invention.

I claim:

1. A toothbrush comprising:

a) an elongated handle having an elongated head coaxially extending from an end of said handle, said head having a substantially flat bristle mounting surface;

b) a plurality of bristles fixed to and extending from the flat surface of said head, said plurality of bristles comprising:

i) a first plurality of bristles, each having a first length, said first plurality of bristles being arranged in at least two rows extending along the length of said head, said first plurality of bristles further being arranged in groups spaced within a respective row, a group of bristles in one row being transversely spaced along the width of the head from a corresponding group in another row, said rows of the first plurality of bristles progressively diverge from the free end of the head towards said handle and said transverse spacing also progressively increases in the same direction;

ii) a second plurality of bristles, each having a second length, said first length being at least 10 percent greater than said second length, a first portion of said second plurality of bristles being arranged in at least one row extending along the length of the head in the space between two adjacent rows of said first plurality of bristles, a second portion of said second plurality of bristles being arranged in a plurality of groups located within the rows of the first plurality of bristles and individually located in the spaces between adjacent groups of the first plurality of bristles;

c) said first plurality of bristles being adapted to clean the interdental spaces between adjacent teeth and said second plurality of bristles being adapted to clean the faces of said teeth, the difference in the length of the first and second plurality of bristles controlling the depth of penetration of the first plurality of bristles into the interdental spaces, said toothbrush being adapted to be used in both a horizontal orientation wherein the brush is generally horizontal to a row of teeth and a vertical orientation wherein the brush is generally perpendicular to a row of teeth.

2. A toothbrush comprising:

a) an elongated handle having an elongated head coaxially extending from an end of said handle, said head having a cleaning means mounting surface;

b) a plurality of cleaning means fixed to and extending from the mounting surface of said head, said plurality of cleaning means comprising:

i) a plurality of cleaning means being flossing means, each having a first length, said plurality of flossing means being arranged in at least two rows extending along a length of said head, said flossing means further being arranged relatively spaced within a respective row, each of said relatively spaced flossing the width of the head from correspondingly relatively spaced flossing means in another row;

ii) a second plurality of cleaning means being tooth surface brushing means, each said tooth surface brushing means having a second length different than said first length, said first length of said flossing means being at least 10 percent greater than said second length, a first portion of said plurality of brushing means being arranged in at least one row extending along the length of the head in the space between two adjacent rows of said plurality of flossing means, the first portion of said plurality of brushing means disposed in said at least one row defining a substantially flat central brushing surface extending along the entire length of said head and wherein the central brushing surface has a height less than that of the flossing means along its entire extent, a second portion of said plurality of brushing means being arranged within the rows of said flossing means and individually located in the spaces between adjacent ones of said flossing means;

c) said flossing means being adapted to clean the interdental spaces between adjacent teeth and said plurality of brushing means being adapted to clean the faces of said teeth, the difference in the lengths of the flossing means and the brushing means controlling the depth of penetration of the flossing means into the interdental spaces, said toothbrush being adapted to be used in both a horizontal orientation wherein the brush is generally horizontal to a row of teeth and a vertical orientation wherein the brush is generally perpendicular to a row of teeth, and said space between said adjacent transversely relatively spaced rows of said flossing means being adapted to receive and clean the crowns of teeth therein by the brushing means and embrace and clean the sides of the teeth and gums by the flossing means.

3. A toothbrush as claimed in claim 2, wherein said rows of said flossing means progressively diverge in relative spacing from one end of said head towards the other end and said transverse spacing of said flossing means progressively increases in the same direction.

4. A toothbrush as claimed in claim 2, wherein said brushing means is flexible and deformable to enable the same to vary in length to thereby variably control the depth of penetration of said flossing means into the interdental spaces.

* * * * *